US007858862B2

(12) United States Patent
Niitsuma

(10) Patent No.: US 7,858,862 B2
(45) Date of Patent: Dec. 28, 2010

(54) PEDAL DEVICE FOR KEYBOARD INSTRUMENT

(75) Inventor: Shinji Niitsuma, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 660 days.

(21) Appl. No.: 11/912,870

(22) PCT Filed: Apr. 7, 2006

(86) PCT No.: PCT/JP2006/307460

§ 371 (c)(1),
(2), (4) Date: Oct. 26, 2007

(87) PCT Pub. No.: WO2006/117976

PCT Pub. Date: Nov. 9, 2006

(65) Prior Publication Data

US 2010/0162873 A1 Jul. 1, 2010

(30) Foreign Application Priority Data

Apr. 28, 2005 (JP) ..... 2005-132325
Dec. 26, 2005 (JP) ..... 2005-372434

(51) Int. Cl.
*G10D 13/02* (2006.01)

(52) U.S. Cl. ..... 84/423 R; 84/426

(58) Field of Classification Search ..... 84/423 R, 84/426, 422.1, 422.3, 422.2, 723–725, 730, 84/746, 72

See application file for complete search history.

(56) References Cited

U.S. PATENT DOCUMENTS 3,365,994 A 1/1968 Rutherford et al.

(Continued)

FOREIGN PATENT DOCUMENTS

JP 58-4130 Y2 1/1983

(Continued)

OTHER PUBLICATIONS

PCT/JP2006/307460 International Search Report w/English translation.

(Continued)

*Primary Examiner*—Kimberly R Lockett
(74) *Attorney, Agent, or Firm*—Crowell & Moring LLP

(57) ABSTRACT

A pedal device of a keyboard instrument which makes it possible to stably secure a required action of a pedal, facilitate assembly thereof, and reduce manufacturing costs. A pedal device for a keyboard instrument of the present invention comprises a chassis 8 having a support portion 30, and a pedal 7 vertically pivotally mounted on the chassis 8, for a downward stepped-on operation. The pedal 7 has a cover 15 formed of a synthetic resin, and pivotally supported on the support portion 30 of the chassis 8, and a pedal body 14 fixed to the cover 15 in a state in which a rear part of the pedal body is covered by the cover 15, and protruding forward from the chassis 8. Further, the pedal device has a chassis 8 having an opening 29 which opens downward, the pedal 7 pivotally supported on the chassis 8 and protruding forward from the opening 29, a return spring 11 disposed under the pedal 7, for retuning the pedal 7 after the stepping-on operation, and a plate 12 fixed to the chassis 8 in a state in which the return spring 11 is interposed, in a manner blocking the opening 29.

20 Claims, 14 Drawing Sheets

U.S. PATENT DOCUMENTS

| | | | | |
|---|---|---|---|---|
| 3,527,134 | A | 9/1970 | Muraki | |
| 3,558,793 | A | 1/1971 | Nakada | |
| 5,107,748 | A | 4/1992 | Muramatsu et al. | |
| 5,905,220 | A | 5/1999 | Lee et al. | |
| 6,376,759 | B1 | 4/2002 | Suzuki | |
| 6,528,713 | B2 * | 3/2003 | Maehara | 84/426 |

FOREIGN PATENT DOCUMENTS

| | | | |
|---|---|---|---|
| JP | 62-17835 | Y2 | 5/1987 |
| JP | 07-219542 | A | 8/1995 |
| JP | 09-212160 | A | 8/1997 |
| JP | 09-305175 | | 11/1997 |
| JP | 2001-22355 | | 1/2001 |
| JP | 2003-223162 | A | 8/2003 |
| JP | 2004-77521 | | 3/2004 |
| JP | 2004-151593 | A | 5/2004 |
| JP | 2005-70565 | A | 3/2005 |

OTHER PUBLICATIONS

German Search Report with English Translation PCT/ISA/210 for PCT/JP2006/307460 with English Translation.

* cited by examiner (a)

(b)

(a)

(b)

PEDAL DEVICE FOR KEYBOARD INSTRUMENT

FIELD OF THE INVENTION

The present invention relates to a pedal device for a keyboard instrument which is used to impart a pedal effect e.g. in an electronic piano or the like.

BACKGROUND ART

As a conventional pedal device for an electronic piano, there has been known one disclosed e.g. in Patent Literature 1. This pedal device is comprised of a pedal box having an inverted U shape in cross section and fixedly mounted between left and right legs of the electronic piano, a frame having a U shape in cross section and accommodated in the pedal box, and three pedals mounted to the frame. Each of the pedal box and the frame has a front wall thereof formed with openings through which the respective pedals are inserted. Further, the frame has a rear wall thereof formed with engaging holes for engagement with the respective pedals.

Each of the pedals is formed by an elongated metal member extending in a front-rear direction, and has peripheral edge parts thereof somewhat extending downward to form a hollow open downward. In the rear end of the upper surface of the pedal, there are arranged an engaging piece and a screw in a manner adjacent to each other in the front-rear direction. The pedal is pivotally supported by the frame, with the engaging piece and the screw held engaged with the upper edge of the engaging hole of the frame from respective opposite sides. The pedal protrudes forward through the openings of the pedal box and the frame, and is pivotally moved downward about the engaging hole of the frame by a step-on operation by a player. Further, between the lower surface of the pedal and the bottom wall of the frame, there is disposed a coil spring for urging the pedal upward. The depressed pedal is returned to its original position by the coil spring.

However, in the above-described conventional pedal device for an electronic piano, since each metal pedal is directly mounted to the frame in a state in which the engaging piece and the screw are engaged with the edge of the associated engaging hole, the pedal cannot perform smooth pivotal motion, which makes it difficult to obtain a smooth pedal touch. Further, noise is apt to be generated in accordance with the pivotal motion of the pedal. For this reason, it is required to apply lubricant, such as grease, to the pivot of the pedal and parts associated therewith so as to eliminate the inconvenience. Further, it is necessary to form the engaging piece on the pedal and attach the screw to the same so as to mount the pedal to the frame, which increases the number of component parts and manufacturing man-hour, resulting in an increase in manufacturing costs.

As another conventional pedal device for an electronic piano, there has been known one disclosed e.g. in Patent Literature 2. This pedal device includes a pedal box, a pedal pivotally mounted to the pedal box, and a coil spring for returning the pedal to its non-depressed position. The pedal box is formed by a molded article made of a metal or a synthetic resin, as one-piece assembly which has two front and rear pedal mounting sections each having a front wall, a rear wall, and a top wall and formed into a downwardly-open inverted U shape in cross section, and a flat plate part connecting between the rear wall of the front pedal mounting section and the front wall of the rear pedal mounting section.

The front and rear walls of the pedal mounting sections are each formed with a rectangular pedal insertion window such that the pedal insertion windows are aligned in the front-rear direction. The rearmost pedal insertion window has a pivot protrusion protruding from the upper edge thereof. The frontmost pedal insertion window has a lower limit stopper protrusion protruding from the lower edge thereof and an upper limit stopper felt affixed to the upper edge thereof. The pedal has an inverted U shape in cross section and extends through the four pedal insertion windows. The pedal is pivotally supported by engagement with the pivot protrusion via a hole formed in the rear end of the pedal, and extends forward from the pedal box.

The coil spring is disposed below the pedal. The coil spring is mounted in a compressed state by inserting a screw from above through holes formed, respectively, in the top wall of the front pedal mounting section and the pedal and fastening a nut screwed onto the lower end of the screw. With this arrangement, when a step-on operation is started, the pedal is pivotally moved downward while compressing the coil spring, and comes into abutment with the stopper protrusion, whereby the lower limit position of the pedal is limited. When the step-on operation is completed, the pedal is pivotally returned upward by the spring force of the coil spring and comes into abutment with the stopper felt, whereby the upper limit position of the pedal is limited.

However, in this conventional pedal device, since the pedal is inserted from the front side into the pedal insertion windows each having closed four sides and aligned in the front-rear direction, it is required to form the pedal into a substantially linear shape, i.e. there are constraints on the shape of the pedal, and hence the degree of freedom is low. Further, when the pedal box is made of a synthetic resin, a portion of a mold is required to have a slide structure so as to form the pedal insertion windows shaped and aligned as above in the respective front and rear walls of each of the pedal mounting sections of the pedal box, which causes an increase in manufacturing costs. Furthermore, since the lower edge of the pedal insertion window against which the pedal abuts when it is stepped on is formed of the synthetic resin, the supporting strength of this portion is insufficient, which can cause deformation and the like problem. In addition, it is required to affix the upper limit stopper felt to the upper edge of the frontmost pedal insertion window having its four sides closed, and this gluing work is troublesome.

Furthermore, since the pedal is stepped on with a large force by a player's foot, the coil spring is generally configured to have a relatively large spring force. In this conventional pedal device, however, in mounting the coil spring, it is required to screw the nut onto the lower end of the screw inserted through the coil spring, etc. and fasten the same while compressing the coil spring against its large spring force, and hence it is very difficult to mount the coil spring.

The present invention has been made in order to solve the above problems, and an object thereof is to provide a pedal device for a keyboard instrument which makes it possible to stably secure a required action of a pedal, facilitate assembly thereof, and reduce manufacturing costs.

[Patent Literature 1] Japanese Laid-Open Patent Publication (Kokai) No. H09-212160

[Patent Literature 2] Japanese Laid-Open Patent Publication (Kokai) No. H09-305175

DISCLOSURE OF THE INVENTION

To attain the object, a pedal device for a keyboard instrument as claimed in claim 1 of the present invention includes a chassis having a support portion, and a pedal vertically pivotally mounted on the chassis, for a downward stepped-on operation, wherein the pedal comprises a cover that is formed of a synthetic resin, and is pivotally supported on the support portion of the chassis, and a pedal body that is fixed to the cover in a state in which a rear part of the pedal body is covered by the cover, and protrudes forward from the chassis.

In this pedal device for a keyboard instrument, the pedal comprises a pedal body, and a cover made of a synthetic resin and fixed to a rear part of the pedal body, and is pivotally supported on the support portion of the chassis. The player steps on the pedal body protruding from the chassis whereby the pedal is pivotally moved downward. Thus, the pedal body is supported on the chassis, not directly but via the cover of synthetic resin, which enables the pedal to perform a smooth pivotal motion, whereby it is possible not only to easily secure a smooth pedal touch, but also to sufficiently suppress noise caused by the pivotal motion of the pedal. This makes it unnecessary to use lubricant for the support portion of the pedal.

An invention as claimed in claim 2 provides a pedal device as claimed in claim 1, wherein a guide portion is integrally formed with the cover, for being guided by the chassis to thereby restrict a lateral movement of the pedal.

With this arrangement, the guide portion formed on the cover is guided by the chassis, whereby the lateral movement of the pedal is restricted. Further, since the guide portion is formed integrally with the cover, a separate guide part becomes unnecessary, which makes it possible to reduce the manufacturing costs. Further, the guide portion is also made of a synthetic resin, and hence even when the guide portion is brought into contact with a portion of the chassis which guides the guide portion, noise is difficult to be produced, and a smooth pedal touch is maintained. This makes it unnecessary to use lubricant at the portions of the guide portion and the chassis where they are brought into contact.

An invention as claimed in claim 3 provides a pedal device as claimed in claim 1 or 2, further comprising an optical sensor provided inside the chassis, for detecting a stepped-on amount of the pedal, wherein a light-shielding portion is integrally formed with the cover, for blocking light from entering the optical sensor from outside of the chassis.

With this arrangement, the optical sensor provided inside the chassis detects a stepped-on amount of the pedal. Further, the light-shielding portion formed on the cover blocks light from entering the optical sensor from the outside of the chassis, whereby it is possible to secure a stable operation of the optical sensor. Further, since the light-shielding portion is integrally formed with the cover, a separate light-shielding portion becomes unnecessary, which makes it possible to further reduce the manufacturing costs.

An invention as claimed in claim 4 provides a pedal device as claimed in claim 3, wherein the cover has a reflecting surface portion integrally formed therewith, and wherein the optical sensor is formed by a reflection-type optical sensor which has a light-emitting element, and a light-receiving element, and detects the stepped-on amount of the pedal by receiving light emitted from the light-emitting element and reflected from the reflecting surface portion, using the light-receiving element.

With this arrangement, the optical sensor is formed by a reflection-type optical sensor, and detects a stepped-on amount of the pedal by emitting light from the light-emitting element thereof and receiving light reflected from the reflecting surface portion of the pedal, using the light-receiving element. For example, if the pedal body is made of a metal, and the reflecting surface portion is provided on the metal pedal body, a rust may be formed on the pedal body to cause a malfunction of the optical sensor. In contrast, according to this invention, the reflecting surface portion is integrally formed with the cover, and is formed of a synthetic resin, which makes it possible to avoid the above-mentioned malfunction caused by the generation of rust. Therefore, it is possible to secure a stable operation of the optical sensor. Further, since the reflecting surface portion is integrally formed with the cover, a separate reflection part becomes unnecessary, which makes it possible to further reduce the manufacturing costs.

An invention as claimed in claim 5 provides a pedal device as claimed in any of claims 1 to 4, further comprising a coil spring for returning the pedal after the stepped-on operation, wherein the cover is integrally formed with a positioning protrusion for positioning the coil spring.

With this arrangement, after the stepped-on operation, the pedal returns to its original position by the urging force of the coil spring. Further, the coil spring can be easily positioned at a predetermined location by the positioning protrusion formed on the pedal. Further, since the positioning protrusion is formed integrally with the cover, a separate poisoning part becomes unnecessary, which makes it possible to reduce the manufacturing costs.

To attain the object, a pedal device for a keyboard instrument, as claimed in claim 6 of the present invention, comprises a chassis, a pedal vertically pivotally supported on the chassis, for a downward stepped-on operation, an optical sensor provided inside the chassis, for detecting a stepped-on amount of the pedal, and a light-shielding member formed of a synthetic resin and integrally formed with the pedal, for blocking light from entering the optical sensor from outside of the chassis.

In this pedal device for a keyboard instrument, the optical sensor provided inside the chassis detects a stepped-on amount of the pedal. Further, the light-shielding member integrally formed with the pedal blocks light from entering the optical sensor from the outside of the chassis, whereby it is possible to secure a stable operation of the optical sensor.

An invention as claimed in claim 7 provides a pedal device as claimed in claim 6, wherein a guide portion is integrally formed with the light-shielding member, for being guided by the chassis to thereby restrict a lateral movement of the pedal.

With this arrangement, the guide portion formed on the light-shielding member is guided by the chassis, whereby the lateral movement of the pedal is restricted. Further, since the guide portion is formed integrally with the light-shielding member, a separate guide member becomes unnecessary, which makes it possible to reduce the manufacturing costs. Further, since the guide portion is also formed of a synthetic resin, it is possible, without using lubricant at respective portions of the guide portion and the chassis where they are brought into contact, to suppress generation of noise during pivotal motion of the pedal, and secure a smooth pedal touch.

An invention as claimed in claim 8 provides a pedal device as claimed in claim 6 or 7, wherein the light-shielding member has a reflecting surface portion integrally formed therewith, and wherein the optical sensor is formed by a reflection-type optical sensor which has a light-emitting element, and a light-receiving element, and detects the stepped-on amount of the pedal by receiving light emitted from the light-emitting element and reflected from the reflecting surface portion, using the light-receiving element.

With this arrangement, the optical sensor is formed by a reflection-type optical sensor, and detects a stepped-on amount of the pedal by emitting light from the light-emitting element thereof and receiving light reflected from the reflecting surface portion of the pedal using the light-receiving element. Further, the reflecting surface portion is integrally formed with the light-shielding member, and is formed of a synthetic resin, which makes it possible to avoid the malfunction caused by rust formed when the reflecting surface portion is made of a metal. This makes it possible to secure a stable operation of the optical sensor. Further, since the reflecting surface portion is integrally formed with the light-shielding member, a separate reflection part becomes unnecessary, which makes it possible to further reduce the manufacturing costs.

An invention as claimed in claim 9 provides a pedal device as claimed in any of claims 6 to 8, further comprising a coil spring for returning the pedal after the stepped-on operation, wherein the light-shielding member is integrally formed with a positioning protrusion for positioning the coil spring.

With this arrangement, the coil spring for returning the pedal after the stepped-on operation can be easily positioned at a predetermined location using the positioning protrusion. Further, since the positioning protrusion is formed integrally with the light-shielding member, a separate poisoning part becomes unnecessary, which makes it possible to reduce the manufacturing costs.

Further, to attain the object, a pedal device for a keyboard instrument as claimed in claim 10 of the present invention provides a pedal device for a keyboard instrument, comprising a chassis, a pedal vertically pivotally supported on the chassis, for a downward stepped-on operation, an optical sensor provided inside the chassis, for detecting a stepped-on amount of the pedal, and a guide member formed of a synthetic resin and integrally formed with the pedal, for being guided by the chassis to thereby restrict a lateral movement of the pedal, wherein the guide member has a reflecting surface portion integrally formed therewith, the pedal device further comprising a reflection-type optical sensor which has a light-emitting element, and a light-receiving element, and detects a stepped-on amount of the pedal by receiving light emitted from the light-emitting element and reflected from the reflecting surface portion, using the light-receiving element.

In this pedal device for a keyboard instrument, the guide member integrally formed with the pedal is guided by the chassis, whereby the lateral movement of the pedal is restricted. Further, since the guide member is made of a synthetic resin, it is possible to suppress noise caused by pivotal motion of the pedal, without using lubricant where respective portions of the guide member and the chassis which guide the guide member are brought into contact, and maintain a smooth pedal touch. Further, light is emitted from the light-emitting element of a reflection-type optical sensor, and light reflected from the reflecting surface portion of the pedal is received by the light-receiving element, whereby a stepped-on amount of the pedal is detected. In this case, the reflecting surface portion is integrally formed with the guide member, and is formed of a synthetic resin, which makes it possible to avoid the malfunction caused by rust formed when the reflecting surface portion is made of a metal, which makes it possible to secure a stable operation of the optical sensor. Further, since the reflecting surface portion is integrally formed with the guide member, a separate reflection part becomes unnecessary, which makes it possible to further reduce the manufacturing costs.

An invention as claimed in claim 11 provides a pedal device as claimed in claim 10, further comprising a coil spring for returning the pedal after the stepped-on operation, wherein the guide member is integrally formed with a positioning protrusion for positioning the coil spring.

With this arrangement, the coil spring for returning the pedal after the stepped-on operation can be easily positioned at a predetermined location using the positioning protrusion. Further, since the positioning protrusion is formed integrally with the guide member, a separate poisoning part becomes unnecessary, which makes it possible to reduce the manufacturing costs.

To attain the object, a pedal device for a keyboard instrument, as claimed in claim 12 comprises a chassis having an opening which opens downward, a pedal vertically pivotally supported on the chassis and protruding forward from the opening, for a downward stepped-on operation, a return spring disposed under the pedal, for retuning the pedal after the stepped-on operation, and a plate fixed to the chassis in a state in which the return spring is interposed therebetween, in a manner blocking the opening.

According to this pedal device for a keyboard instrument, since the opening of the chassis opens downward, it is possible to insert the pedal via the opening from below. Therefore, differently from the prior art, it is not necessary to insert the pedal into a plurality of pedal insertion windows each having closed four sides, and hence the constraints on the shape of the pedal are reduced, to increase the degree of freedom. For the same reason, even when the chassis is formed of a synthetic resin, differently from the prior art, it is unnecessary to form a portion of a mold of the chassis for forming the pedal insertion window such that it has a slide structure, which makes it possible to reduce the manufacturing costs.

Further, since the opening of the chassis is blocked by the plate fixed to the chassis, the plate can be caused to hold the pedal and the return spring such that they are prevented from falling off downward, and have the pedal brought into contact therewith to thereby set the lower limit position of the pedal. That is, the plate can be used as a retaining plate for retaining the plate and the return spring, and also as a lower limit stopper of the pedal.

An invention as claimed in claim 13 provides a pedal device as claimed in claim 12, wherein the chassis is formed of a synthetic resin, and the plate is formed of a metal.

With this arrangement, since the chassis pivotally supporting the pedal is formed of a synthetic resin, the pedal performs a smooth pivotal motion, which makes it possible to secure a smooth pedal touch, and suppress noise caused by the pivotal motion of the pedal. On the other hand, since the plate is formed of a metal, and has a high rigidity and strength, it is possible to sufficiently support load from the pedal when the pedal is stepped on, and sufficiently suppress deformation of the plate.

An invention as claimed in claim 14 provides a pedal device as claimed in claim 12 or 13, wherein the pedal is formed by a plurality of pedals arranged in a left-right direction, the return spring being formed by a plurality of return springs provided for the pedals, respectively, the plate being formed by a single plate fixed to the chassis in a state in which the return springs are interposed between the chassis and the plate.

With this arrangement, the pedal and the return spring are each formed by a plurality of pedals and a plurality of return springs, whereas the plate is formed by a single plate. Therefore, compared with the case where a plurality of plates are provided for the respective pedals, it is possible to reduce the number of component parts, and thereby further reduce the manufacturing costs.

To attain the object, a pedal device for a keyboard instrument as claimed in claim 15 of the present invention comprises a chassis having an opening which opens downward, a pedal vertically pivotally supported on the chassis and protruding forward from the opening, for a downward stepped-on operation, a return spring disposed under the pedal, for retuning the pedal after the stepped-on operation, a plate disposed under the return spring, provisional fixing means for provisionally fixing the plate, in a state in which the return spring is compressed, in a manner blocking the opening, and a screw for fixing the plate provisionally fixed by the provisional fixing means, to the chassis.

According to this pedal device for a keyboard instrument, similarly to the pedal device as claimed in claim 12, the pedal is inserted from below via the opening of the chassis which opens downward, and the opening is blocked by the plate fixed to the chassis. Therefore, it is possible to increase the degree of freedom of the shape of the pedal, and reduce the manufacturing costs by simplification of a mold used when forming the chassis from a synthetic resin.

Further, prior to fixing the plate to the chassis with a screw, the plate is provisionally fixed to the chassis by the provisional fixing means, in a state in which the return spring is compressed. Therefore, differently from the prior art, fixing of the plate thereafter using a screw can be easily carried out without compressing the return spring, in a state not influenced by the large spring force of the return spring, which makes it possible to very easily assemble the pedal device. Further, fastening of the screw can ensure sufficient final mounting strength of the plate.

An invention as claimed in claim 16 provides a pedal device as claimed in claim 15, wherein the provisional fixing means has an engaging hole formed in one of the chassis and the plate, and a hook provided on the other of the chassis and the plate, for being engaged with the engaging hole.

With this arrangement, simply by causing an engaging hole formed in one of the chassis and the plate to be engaged with a hook formed on the other thereof, the plate can be easily provisionally fixed to the chassis. Further, the provisional fixing means can be simply formed by the hood and the engaging hole, and engagement of the two can properly and easily position the plate with respect to the chassis.

Further, an invention as claimed in claim 17 provides a pedal device as claimed in claim 15 or 16, wherein the chassis is formed of a synthetic resin, and the plate is formed of a metal, the screw being screwed into the plate from the chassis side.

With this arrangement, since the screw is screwed into the plate formed of a metal, it is possible to firmly fasten the screw without causing stripping the threads of the screw, which makes it possible to further enhance the mounting strength of the plate.

Further, to attain the object, a pedal device for a keyboard instrument as claimed in claim 18 comprises a chassis having an opening which opens downward, a pedal vertically pivotally supported on the chassis and protruding forward from the opening, for a downward stepped-on operation, a return spring disposed under the pedal, for retuning the pedal after the stepped-on operation, a plate formed of a metal and having a screw hole-provided protrusion formed by fluing, the plate being fixed to the chassis in a state causing compression of the return spring, in a manner blocking the opening, and an adjuster bolt screwed into the screw hole of the protrusion from below, for supporting load from the pedal.

According to this pedal device for a keyboard instrument, similarly to the pedal devices as claimed in claims 12 and 15, it is possible to increase the degree of freedom of the shape of the pedal, and reduce the manufacturing costs by simplification of a mold used when forming the chassis from a synthetic resin. Further, since the adjuster bolt is attached to the plate by being screwed into the screw hole of the protrusion formed by fluing, a separate screwing member, such as an insert nut, can be dispensed with, which makes it possible to further reduce the manufacturing costs.

An invention as claimed in claim 19 provides a pedal device as claimed in claim 18, wherein the plate has a main part extending horizontally, and a reinforcement part extending perpendicularly from the main part.

With this arrangement, the plate has a reinforcement part extending perpendicularly from the main part, which makes it possible to increase the rigidity and strength of the plate. As a consequence, it is possible to sufficiently support load applied when the pedal is stepped on and a reaction force from the adjuster bolt, and suppress deformation and the like of the plate.

An invention as claimed in claim 20 provides a pedal device as claimed in claim 18 or 19, wherein a cushion is affixed to a top surface of the plate, for having the pedal brought into contact therewith when the pedal is stepped on.

With this arrangement, prior to mounting the plate on the chassis, a cushion can be affixed to a top surface of the plate in a state in which the plate is open, which makes it possible to easily affix the cushion to the plate.

BEST MODE FOR CARRYING OUT THE INVENTION

Figure 1:
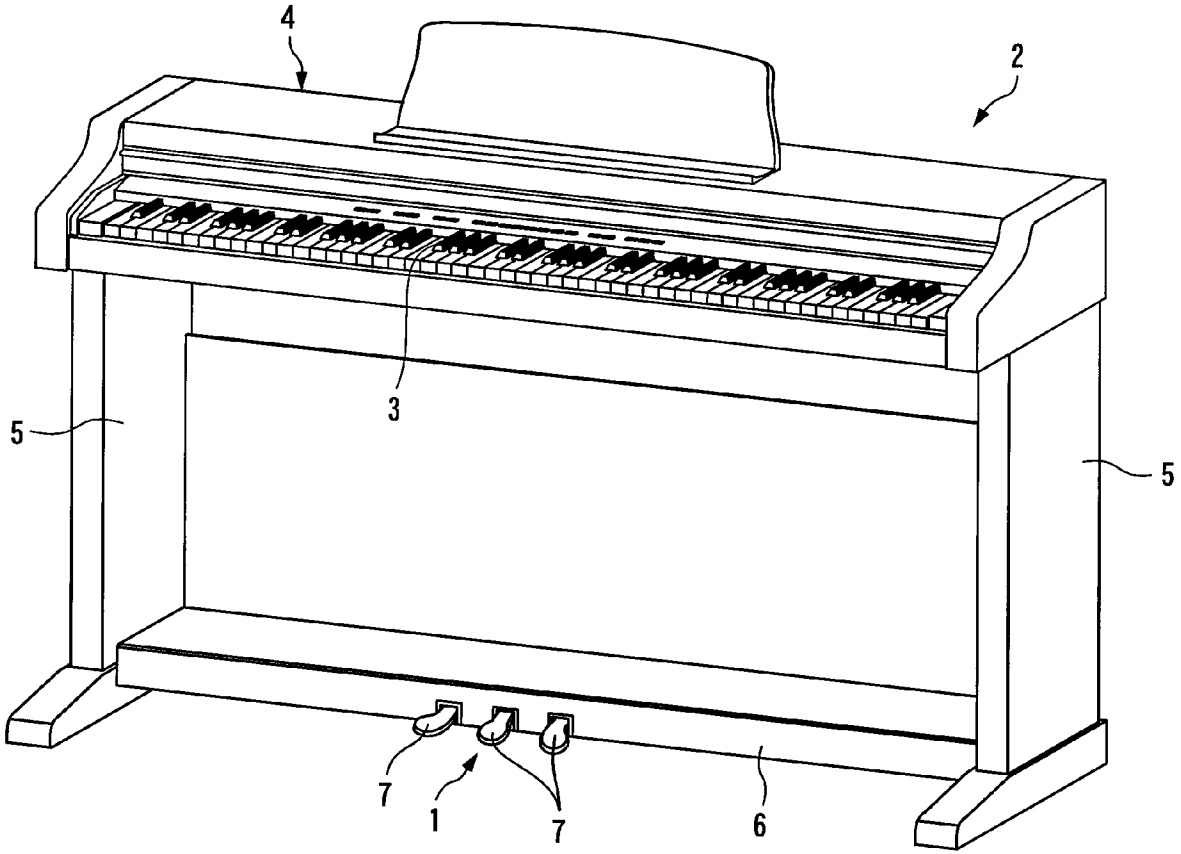
FIG. 1 A perspective view of an electronic piano using a pedal device according to an embodiment of the present invention.

The invention will now be described in detail with reference to the drawings showing a preferred embodiment thereof. FIG. 1 shows an electronic piano 2 using a pedal device 1 to which the present invention is applied. This electronic piano 2 is comprised of a piano body 4 including a keyboard 3, and left and right legs 5, 5 supporting the piano body 4. The pedal device 1 is disposed in the central part of a pedal base 6 bridging between the lower parts of the respective left and right legs 5, 5, and has three pedals 7 (a loud pedal, a sostenuto pedal, and a soft pedal arranged from right to left in the mentioned order) each protruding forward from the pedal base 6.

Figure 2:
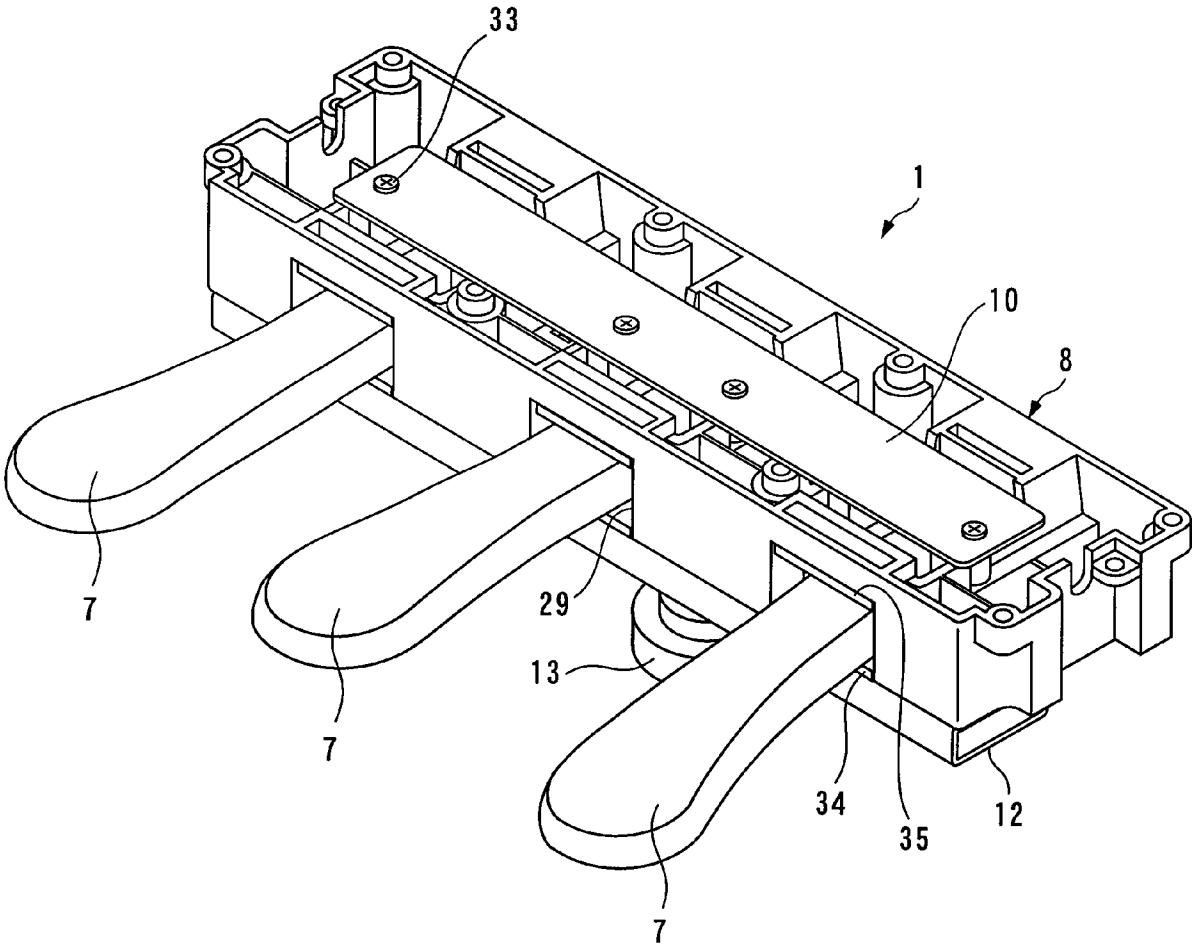
FIG. 2 A perspective view of the pedal device as viewed from above.
Figure 3:
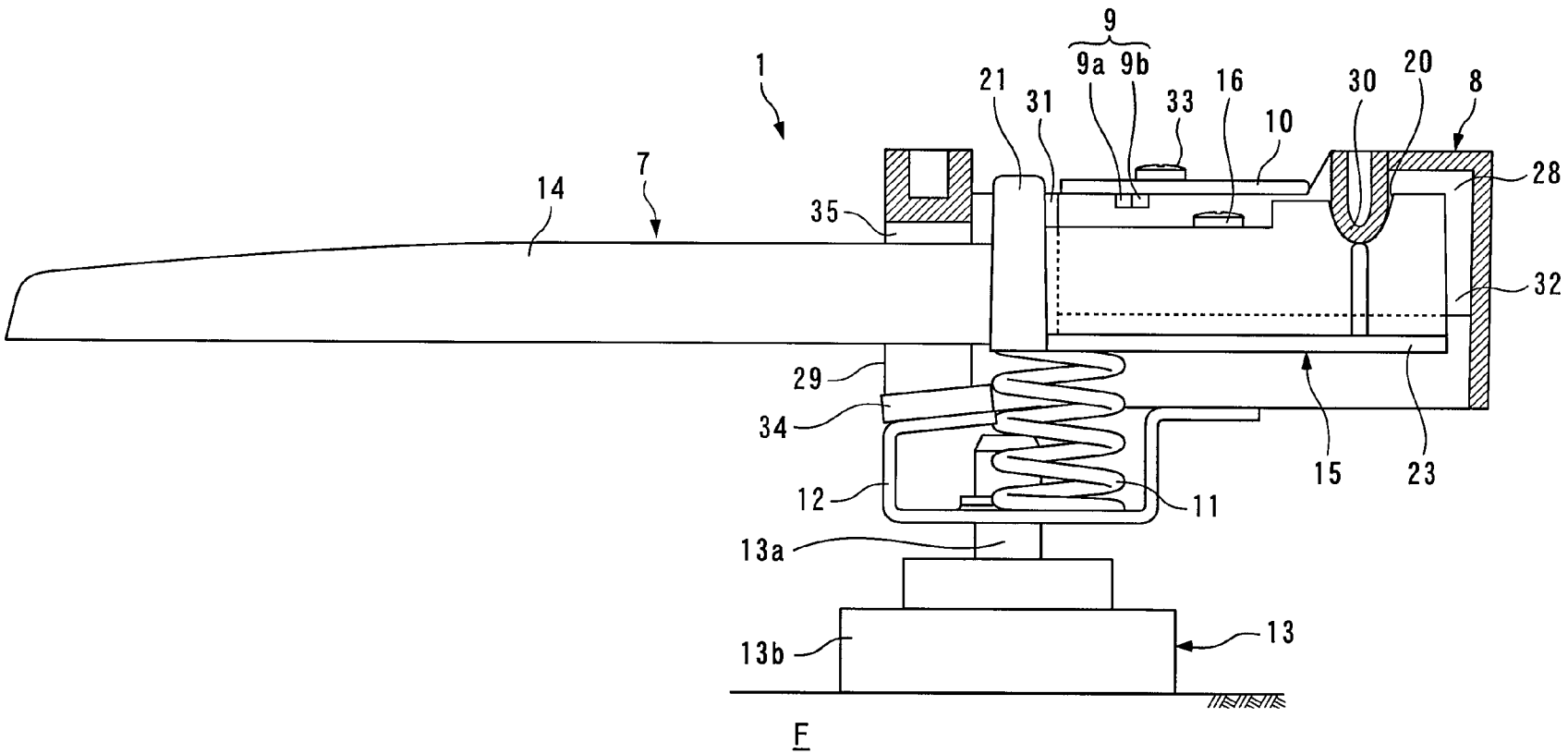
FIG. 3 A partially-cutaway side view of the pedal device in a non-stepped-on state of a pedal.

As shown in FIGS. 2 and 3, the pedal device 1 includes not only the three pedals 7, but also a chassis 8 to which the pedals 7 are pivotally mounted, optical sensors 9 and a printed circuit board 10 for detecting the stepped-on amounts of the respective pedals 7, coil springs 11 (return springs) for returning the respective pedals after completion of a step-on operation, a stopper plate 12 (plate) mounted on the lower surface of the chassis 8, and an adjuster bolt 13 attached to the stopper plate 12.

Figure 4:
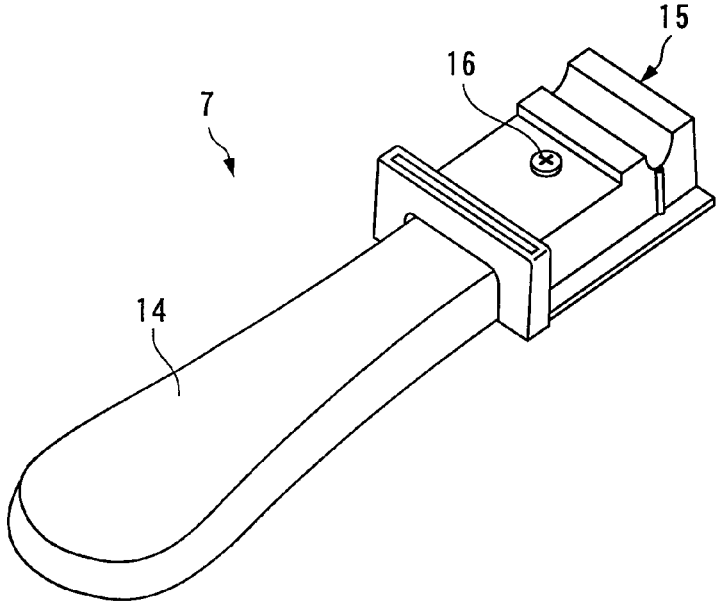
FIGS. 4(*a*) a perspective view of the pedal as viewed from above, and (b) a perspective view of the pedal as viewed from below.
Figure 4:
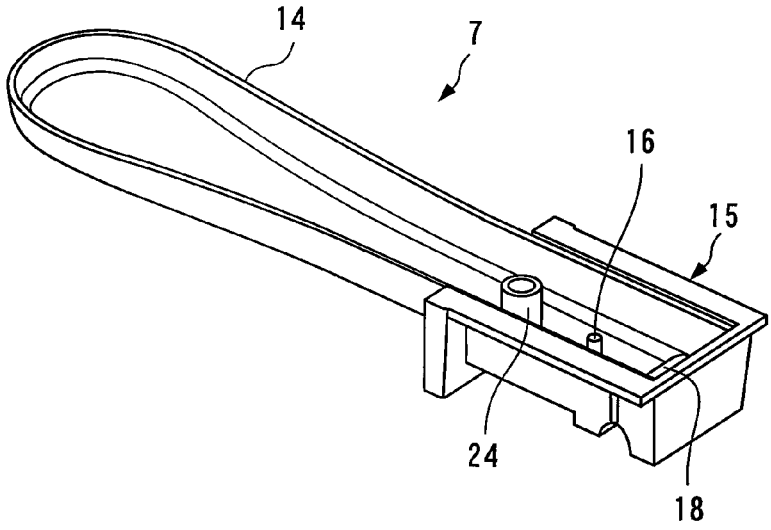
Figure 5:
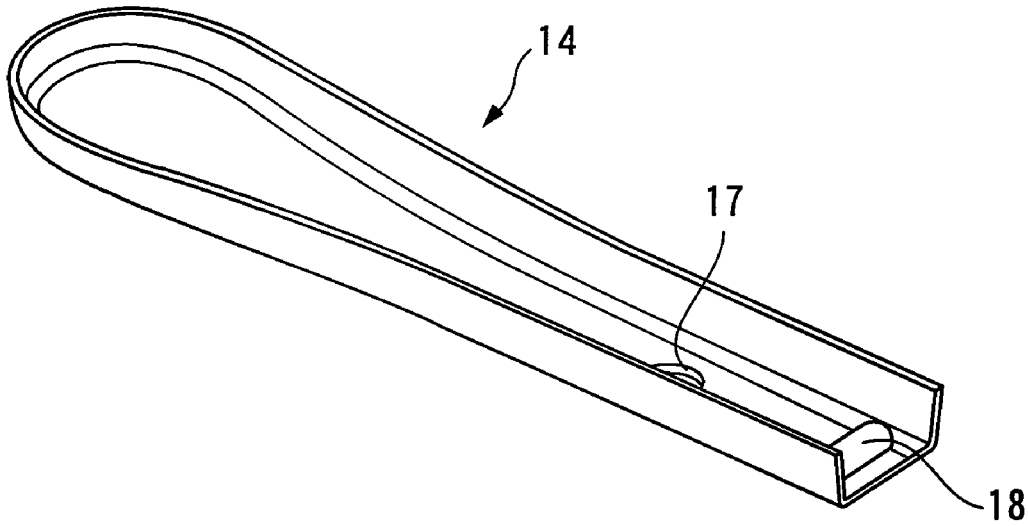
FIG. 5 A perspective view of a pedal body as viewed from below.

As shown in FIG. 4, each pedal 7 is formed by assembling a pedal body 14 and a cover 15 into one piece by a screw 16. Similarly to a conventional pedal, the pedal body 14 is formed of a metal, such as brass, and has a shape elongated in the front-rear direction with a rear part having a constant width and a front part gently widened toward and having a rounded shape. Further, as shown in FIG. 5, the pedal body 14 has a peripheral edge portion, except a rear end edge, slightly extending downward to form a shallow hollow open downward. The pedal body 14 has a rear part thereof formed with a hole 17 through which a positioning protrusion 24, described hereinafter, of the cover 15 is inserted, and a recess 18 corresponding to a supported recess 20 of the cover 15 formed in the rear end thereof in a manner extending in the left-right direction.

Figure 6:
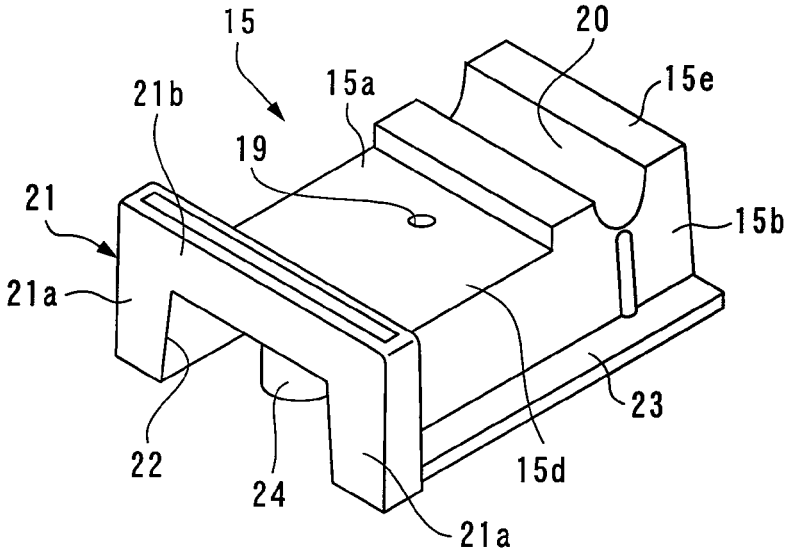
FIGS. 6(*a*) a perspective view of a cover as viewed from above, and (b) a perspective view of the cover as viewed from below.
Figure 6:
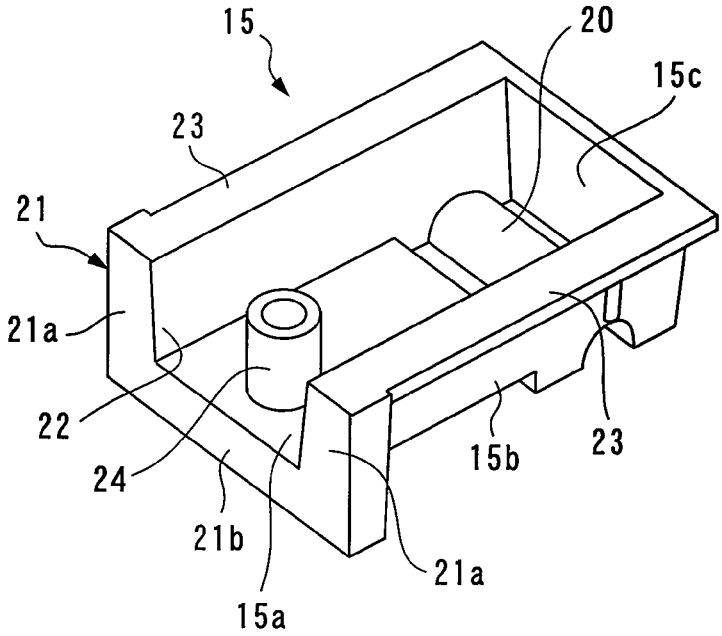

The cover 15 is formed by a molded article of a synthetic resin, such as a white polyacetal resin. As shown in FIG. 6, the cover 15 has a top wall 15*a*, left and right side walls 15*b*, 15*b*, and a rear wall 15*c*, and is formed into a hollow shape having open front and bottom faces. A front part 15*d* of the top wall 15*a* is formed with a screw hole 19. The front part 15*d* of the top wall 15*a* has a flat upper surface, and a portion of the upper surface opposed to the optical sensor 9 functions as a reflecting surface portion for reflecting light emitted from a light-emitting element 9*a* of the optical sensor 9. A rear part 15*e* of the top wall 15*a* is somewhat higher than the front part 15*d*, and the supported recess 20 semicircular in cross section is formed in the rear part 15*e* in a manner extending transversely entirely across the rear part 15*e*.

Further, the cover 15 has a front end erected as a guide part 21. The guide part 21 has larger width and height than those of the top wall 15*a* to form a flange shape, and is formed into an inverted U shape with left and right vertical parts 21*a*, 21*a* and a horizontal part 21*b* (light-shielding portion) bridging between the upper ends of the respective vertical parts 21*a*, 21*a*, such that the left and right vertical parts 21*a*, 21*a* and the horizontal part 21*b* define an opening 22. Fins 23 (light-shielding portions) protrude outward from the lower ends of the respective left and right side walls 15*b*, 15*b* of the cover 15. The fins 23 extend in the front-rear direction, and the front ends thereof are continuous with the lower ends of the respective vertical parts 21*a* of the guide part 21. Further, a hollow cylindrical positioning protrusion 24 is provided on the front portion of the lower surface of the top wall 15*a* of the cover 15, for positioning the coil spring 11.

As shown in FIG. 4, the rear part of the pedal body 14 is fitted from below into the cover 15 constructed as above, and the pedal body 14 and the cover 15 are fixed to each other by the screw 16 inserted through the hole 19 of the cover 15. In this state, the rear part of the pedal body 14 is covered by the cover 15, and the front part of the same protrudes forward from the opening 22 of the cover 15. Further, the recess 18 of the pedal body 14 is fitted into the supported recess 20 of the cover 15, and the positioning protrusion 24 of the cover 15 protrudes downward through the hole 17 of the pedal body 14. The coil spring 11 is fitted on the positioning protrusion 24, whereby the coil spring 11 is positioned at a predetermined location of the pedal 7.

Figure 7:
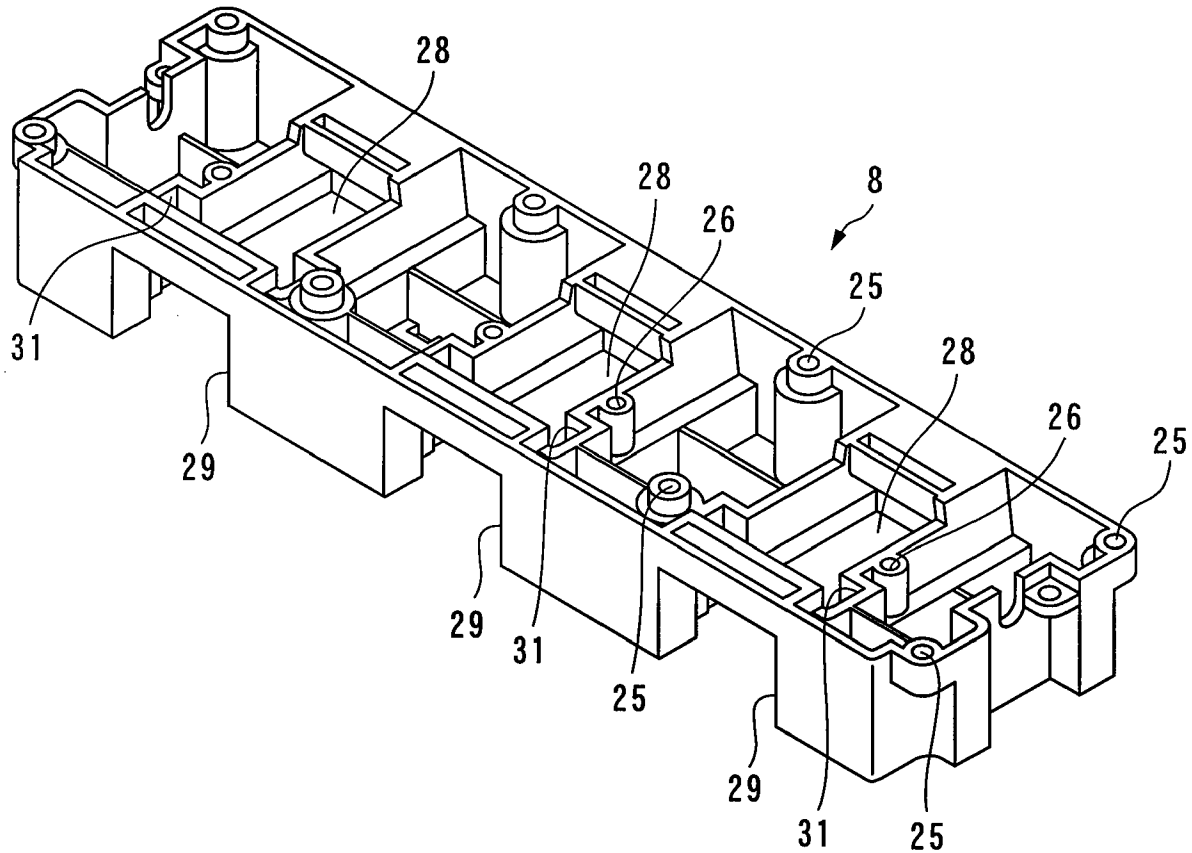
FIG. 7 A perspective view of a chassis as viewed from above.
Figure 8:
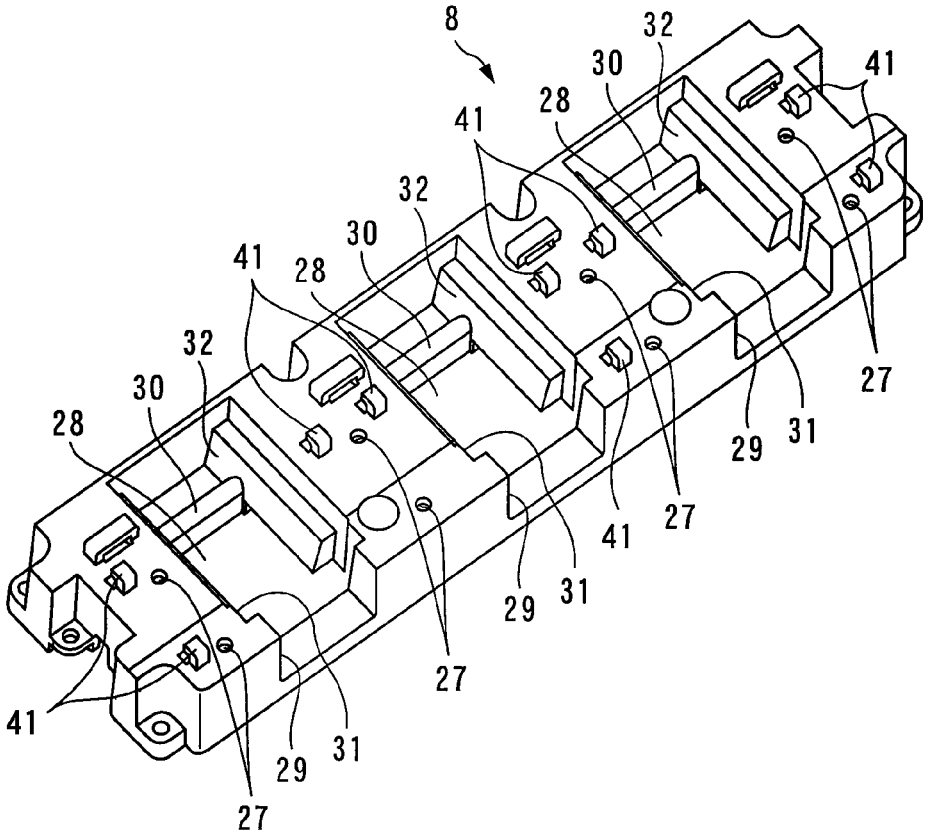
FIG. 8 A perspective view of the chassis as viewed from below.

As shown in FIGS. 7 and 8, the chassis 8 is in the form of a rectangular parallelepiped elongated in the left-right direction, and is formed by a molded article of a synthetic resin, such as an ABS resin. On the upper surface of the chassis 8, there are formed a plurality of holes 25 for use in screwing the chassis 8 to the pedal base 6, while on the lower surface of the chassis 8, there are formed a plurality of holes 27 for use in screwing the presser plate 12 to the chassis 8. Further, at respective predetermined locations on the lower surface of the chassis 8, there are formed a plurality of hooks 41 for temporarily securing the presser plate 12 to the chassis 8 before screwing. Each of the hooks 41 has an L shape in cross section, and extends downward and rearward.

Figure 9:
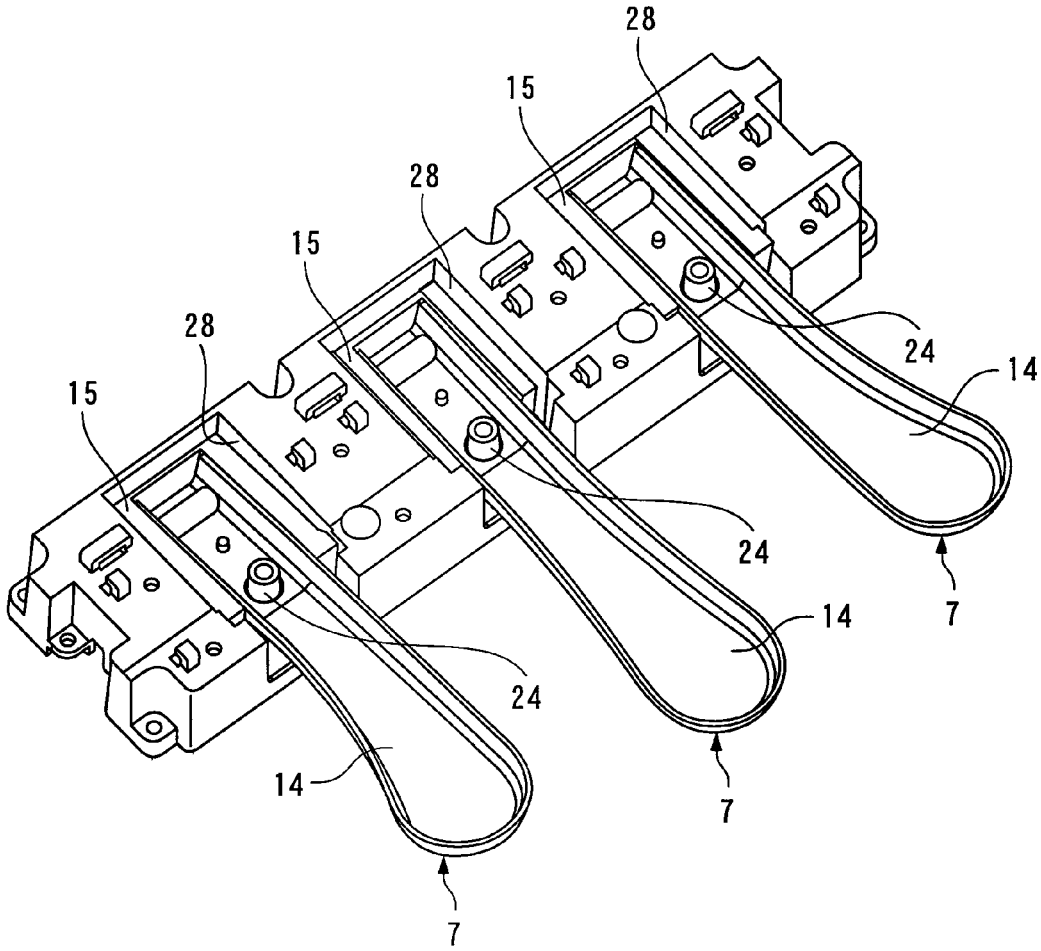
FIG. 9 A perspective view of the chassis with pedals mounted therein, as viewed from below.
Figure 10:
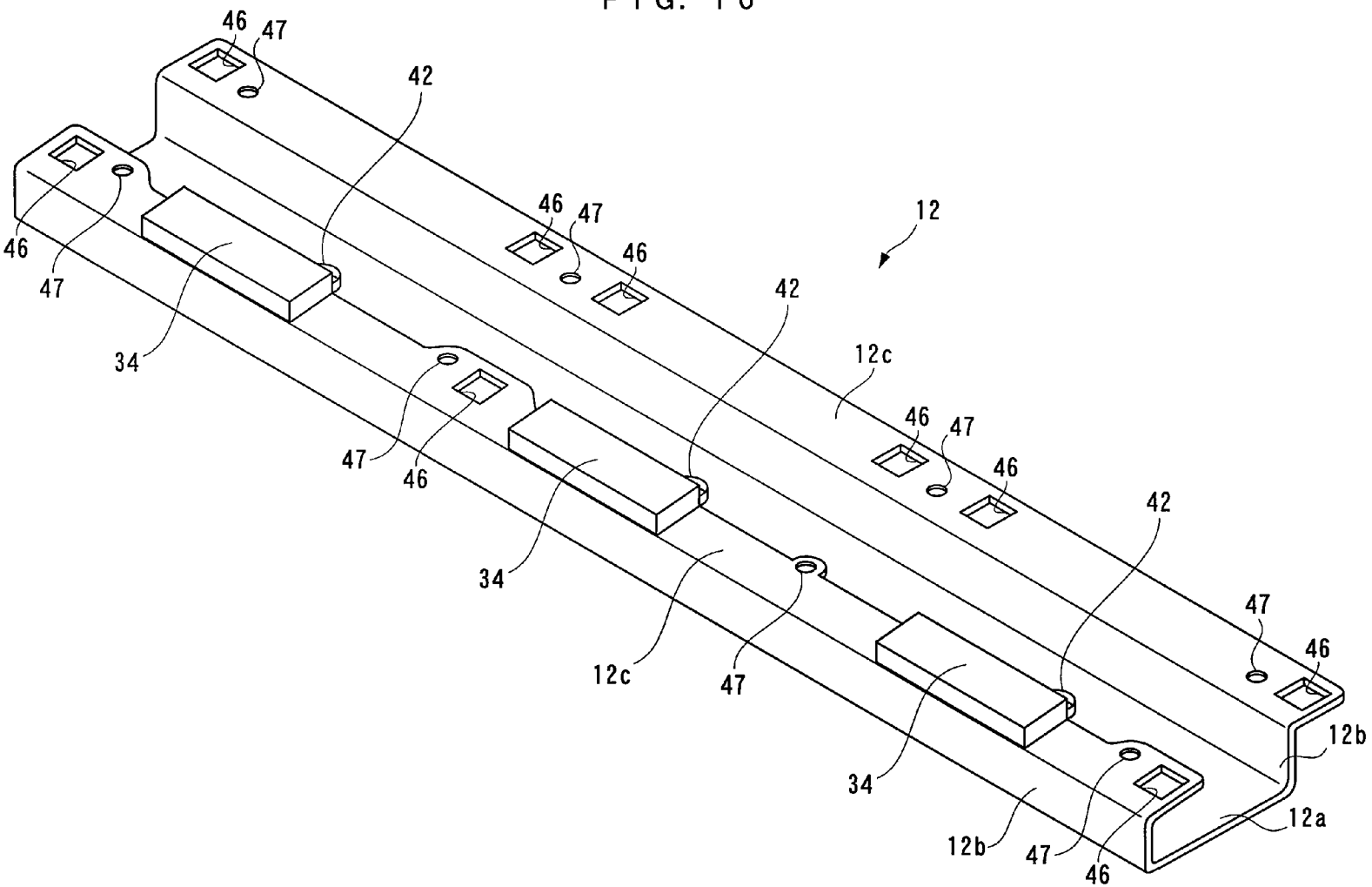
FIG. 10 A perspective view of a presser plate as viewed from above.
Figure 11:
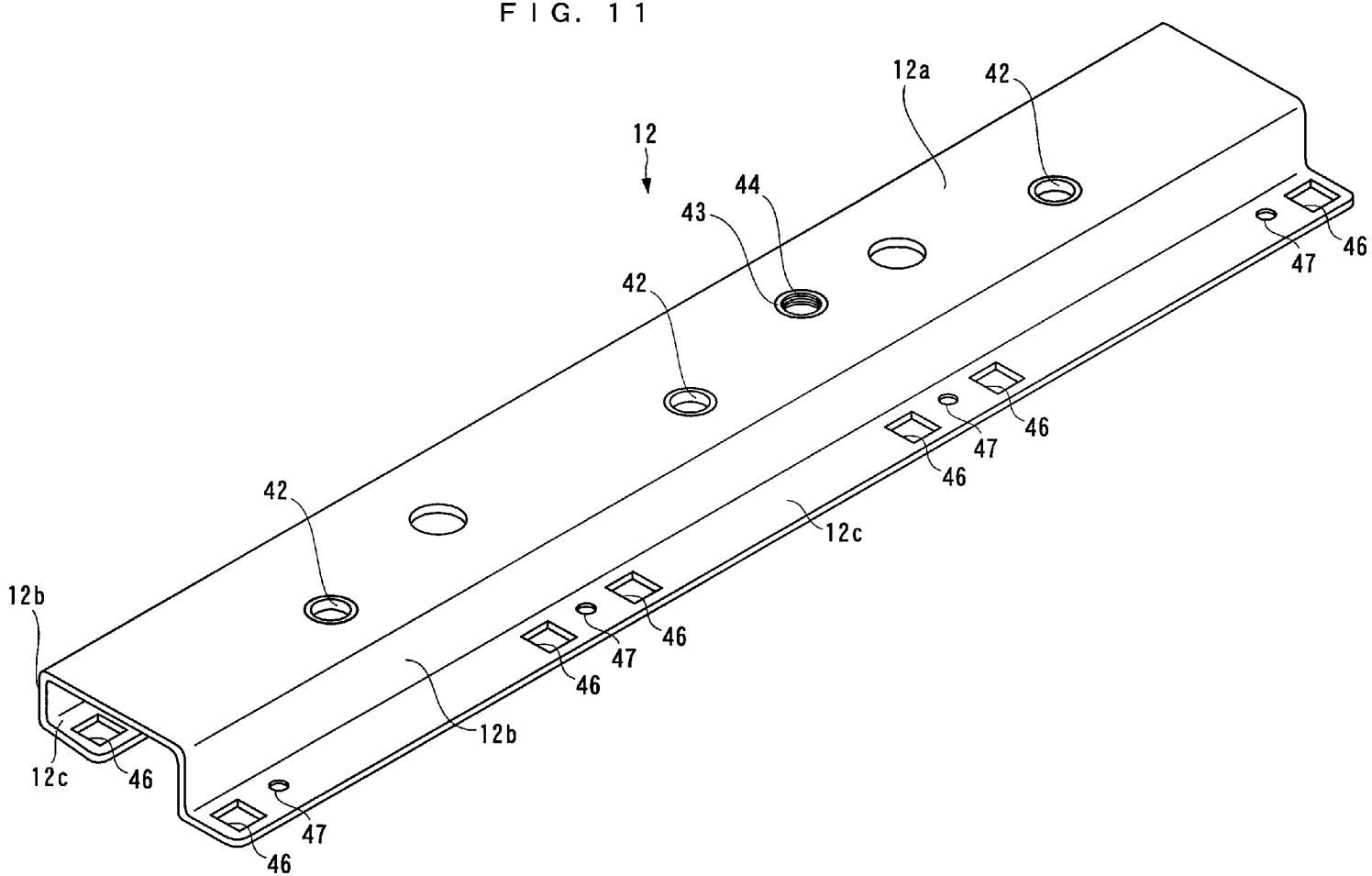
FIG. 11 A perspective view of the presser plate as viewed from below.

Further, the chassis 8 is provided with three pedal-holding sections 28 which each open downward and are arranged in parallel in the left-right direction, and the front wall of the chassis 8 is formed with three openings 29 which are continuous with the respective pedal-holding sections 28 and open downward and frontward. As shown in FIG. 9, each of the pedal-holding sections 28 holds the portion of the pedal 7 covered by the cover 15, and the pedal body 14 protrudes forward through the opening 29.

As shown in FIGS. 3 and 8, each pedal-holding section 28 of the chassis 8 is provided with a support portion 30, at an upper location in the rear part thereof. The support portion 30 extends in the left-right direction, and has a U shape in cross section with a lower end thereof formed into a semicircular shape. The supported recess 20 of the cover 15 is in engagement with the support portion 30, whereby the pedal 7 is supported in a manner pivotally movable about the support portion 30.

The front end of the pedal-holding section 28 is formed as a guide hole 31 having a predetermined width increased in the left-right direction, and the guide part 21 of the cover 15 of the pedal 7 is disposed in the guide hole 31. Further, on the upper portions of respective left and right inner surfaces of the pedal-holding section 28, there are formed guide blocks 32, 32 extending in the front-rear direction with a predetermined spacing therebetween, and the other portion of the cover 15 than the guide part 21 is inserted between the guide blocks 32, 32 such that the guide blocks 32, 32 are covered by the respective fins 23, 23 of the cover 15 from below.

As shown in FIG. 2, the printed circuit board 10 extends along the chassis 8 in the left-right direction, and is fixed to the top of the chassis 8 by screws 33 inserted through the respective holes 26 of the chassis 8. The printed circuit board 10 is connected to a sounding controller (not shone). Further, the optical sensor 9 is disposed on the reverse side of the printed circuit board 10 at a location corresponding to each pedal 7. As shown in FIG. 3, the optical sensor 9 is a reflection type having the light-emitting element 9*a* and the light-receiving element 9*b*. Specifically, the optical sensor 9 is configured to radiate light emitted from the light-emitting element 9*a* toward the reflecting surface portion, i.e. the front part 15*d* of the top wall 15*a* of the cover 15, and receive light reflected from the reflecting surface portion, using the light-receiving element 9*b*. The stepped-on amount of the pedal 7 is detected based on a time difference between light-emitting timing of the light-emitting element 9*a* and light-receiving timing of the light-receiving element 9*b*.

The presser plate 12 is fixed to the lower face of the chassis 8 in a manner blocking the pedal-holding sections 28 and the openings 29. The presser plate 12 holds the pedals 7 and the coil springs 11 so as to prevent them from falling off downward, and functions as a stopper for setting the lower limit position of the pedals 7. The presser plate 12 is formed by a bent steel plate, and is comprised of a main part 12*a* extending horizontally in the left-right direction, reinforcement parts 12*b*, 12*b* vertically extending upward from the respective front and rear ends of the main part 12*a*, and mounting parts 12*c*, 12*c* extending rearward from the upper ends of the respective reinforcement parts 12*b*, 12*b*.

The main part 12*a* of the presser plate 12 has three protrusions 42 formed at respective locations corresponding to the respective pedals 7, for positioning the coil springs 11, and a single protrusion 43 formed in the center thereof, for mounting an adjuster bolt 13. Each of these protrusions is formed by fluing, to protrude upward, and the protrusion 43 is formed with a screw hole 44. Further, two bolt holes 45 for use in inserting respective screws (not shown) for fixing the chassis 8 to the pedal base 6 are formed in the main part 12*a* at respective two predetermined locations.

Each of the mounting parts 12*c* of the presser plate 12 has a plurality of square engaging holes 46 formed at locations corresponding to the respective hooks 41 of the chassis 8, and a plurality of holes 47 formed at locations corresponding to the respective holes 27 of the chassis 8. Further, three cushions made of felt or hard rubber are affixed to the upper surface of the front mounting part 12 at locations corresponding to the respective pedals 7. Furthermore, similar cushions 35 are affixed to the upper edge parts, which are located above the upper surface of the front mounting part 12*c*, of the respective openings 29 of the chassis 8 (see FIG. 3).

The adjuster bolt 13 is disposed in the center of the pedal device 10 in the left-right direction, and is comprised of a bolt part 13*a* screwed into the screw hole 44 of the protrusion 43 of the presser plate 12 in a vertically movable manner, and a disk-shaped pressure-contact part 13*b* fixed to the lower end of the bolt part 13*a*. By turning the adjuster bolt 13, the pressure-contact part 13*b* is installed on a floor F in a state pressed against the same to support load acting downward when the pedal 7 is stepped on.

Figure 12:
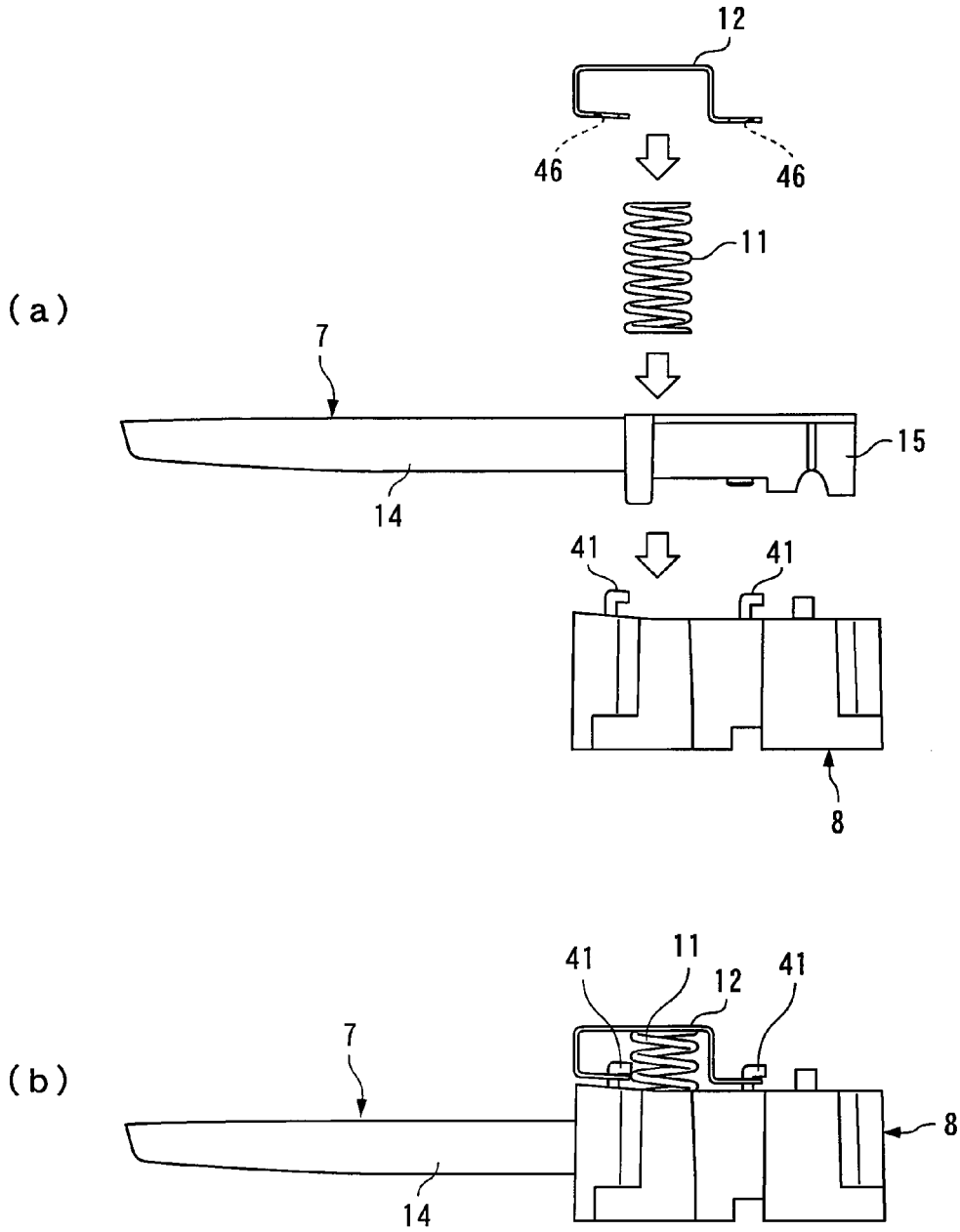
FIG. 12 Views useful in explaining a method of assembling the pedal device.
Figure 13:
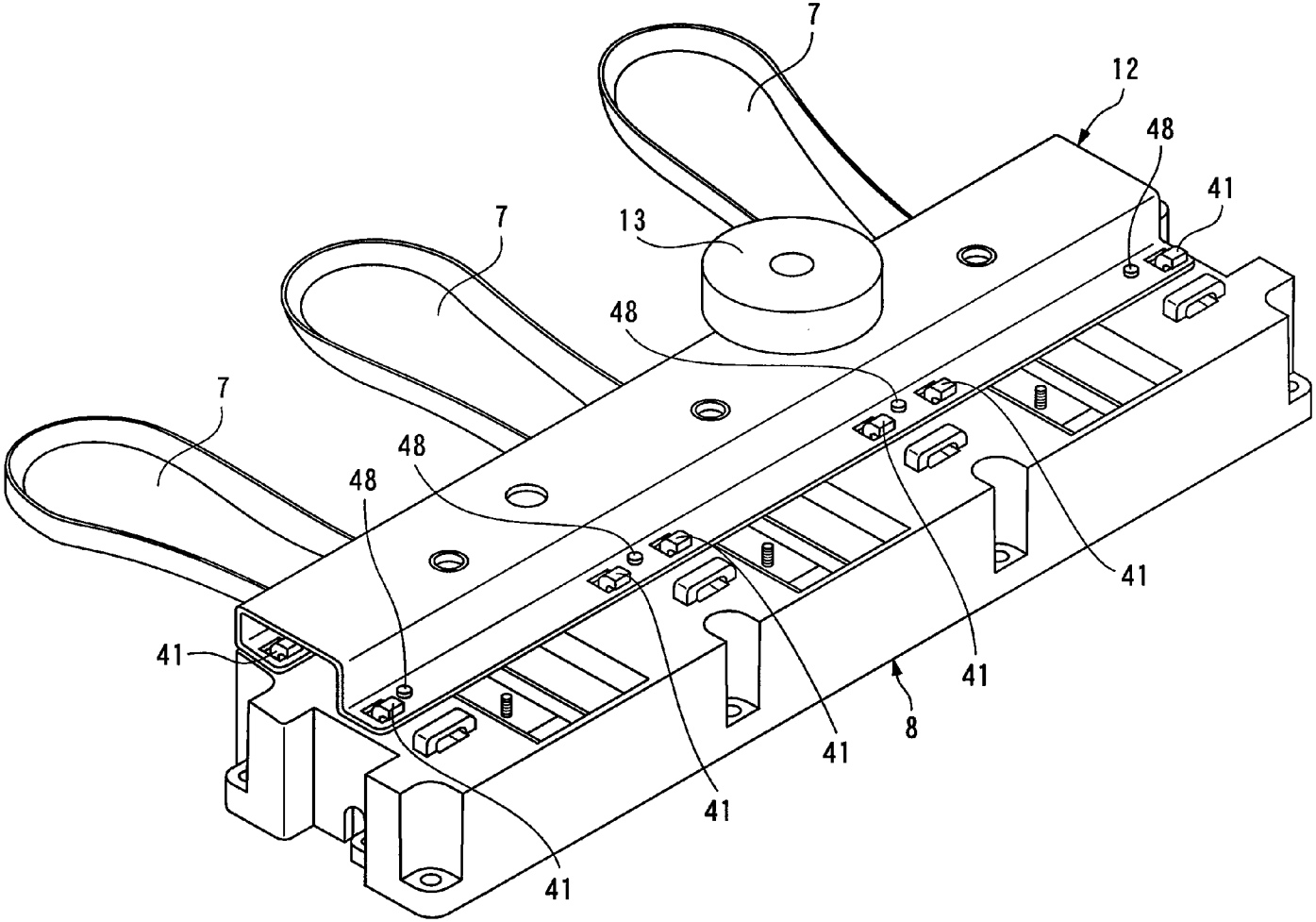
FIG. 13 A perspective view of the pedal device as viewed from below.

The pedal device 1 constructed as above is assembled in a procedure illustrated in FIG. 12. More specifically, as shown in FIG. 12(*a*), the portion of each pedal 7 covered by the cover 15 is inserted into the associated pedal-holding section 28 of the chassis 8 in a state where the chassis 8 is inverted. Then, each coil spring 11 is fitted on the positioning protrusion 24 (see FIG. 4(*b*)) of the associated pedal 7. This causes the coil spring 11 to be positioned at a predetermined location on the associated pedal 7. Next, the presser plate 12 is placed on the three coil springs 11 in a manner spanning these. At this time, the three protrusions 42 for positioning the presser plate 12 are fitted in the respective coil springs 11, whereby the presser plate 12 is correctly positioned with respect to the coil springs 11.

Then, the presser plate 12 is pressed toward the chassis 8 while compressing the coil springs 11, to thereby fit the engaging holes 46 of the presser plate 12 on the respective hooks 41 of the chassis 8. Thereafter, the presser plate 12 is slid toward the pedal bodies 14 until the rear edge of each of the engaging holes 46 is brought into contact with the associated hook 41. This causes the engaging holes 46 to be brought into engagement with the respective hooks 41, with the spring forces of the respective coil springs 11 acting thereon (see FIG. 12(*b*)), whereby the presser plate 12 is provisionally fixed to the chassis 8 and positioned at the predetermined location on the chassis 8 in the front-rear direction.

Figure 14:
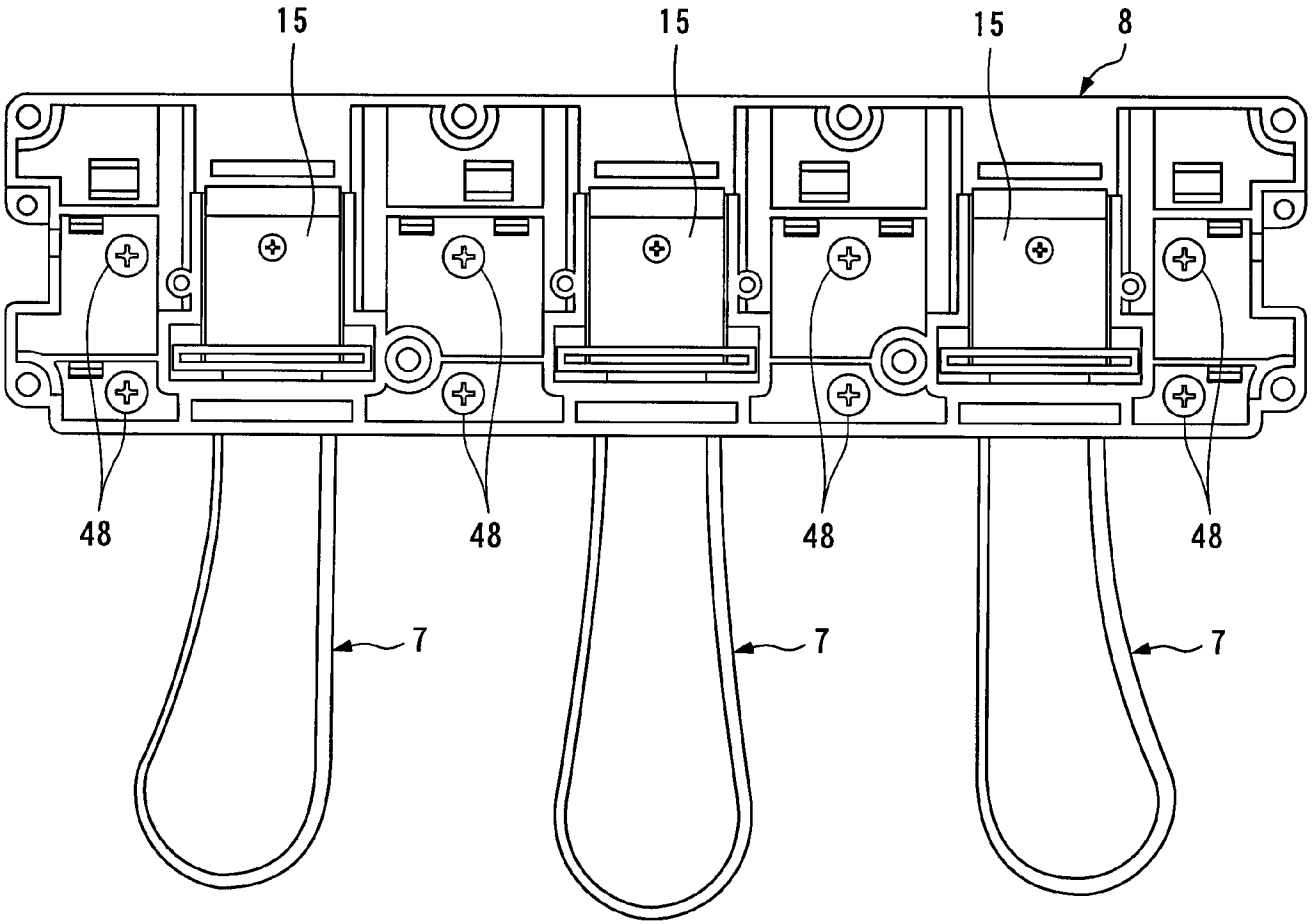
FIG. 14 A plan view of the pedal device from which a printed circuit board is removed.

Next, the chassis 8 is inverted, whereafter the screws 48 are inserted into the respective holes 27 of the chassis 8 and screwed into the respective holes 47 of the presser plate 12 by tapping, to thereby fix the presser plate 12 to the chassis 8 (see FIGS. 14 and 15). Then, the printed circuit board 10 is fixed to the chassis 8 by the screws 33, and after inverting the chassis 8 again, the adjuster bolt 13 is screwed into the screw hole 44 of the protrusion 43 of the presser plate 12 to cause the adjuster bolt 43 to be mounted, whereby assembly of the pedal device 1 is completed.

Next, a description will be given of the action of the pedal device 1. FIG. 3 shows a non-stepped-on state of the pedal 7 in which the pedal 7 is not stepped on. In this state, the pedal 7 is placed in an upper position by the spring force of the coil spring 11 and is held in a horizontal position, causing the pedal body 14 to be held in contact with the cushion 35.

When the pedal body 14 is stepped on from this non-stepped-on state, the pedal 7 pivotally moves downward about the support portion 30 against the spring force of the coil spring 11. The lower limit position of the pedal 7 is set by abutment of the pedal 14 against the cushion 34. When the pedal 7 pivotally moves, the other portion of the cover 15 than the guide part 21 passes through between the guide blocks 32, 32, and the left and right vertical parts 21*a*, 21*a* of the guide part 21 of the cover 15 are guided by the guide hole 31, whereby lateral movement of the pedal 7 is restricted.

The stepped-on amount of the pedal 7 at this time is detected by the optical sensor 9 as described hereinbefore. A signal indicative of the sensed stepped-on amount is delivered to the sounding controller via the printed circuit board 10, and a pedal effect is provided according to the stepped-on amount of the pedal 7. The fins 23, 23 of the cover 15 of the pedal 7 cover the guide blocks 32, 32 of the chassis 8 from below to thereby block external light from entering the chassis 8 from below. Further, as shown in FIG. 3, the horizontal part 21*b* of the guide part 21 covers the front end of the printed circuit board 10 to thereby block external light from entering the chassis 8 from above.

When the step-on operation of the pedal 7 is completed, the pedal 7 is pivotally moved upward by the spring force of the coil spring 11 and is brought into abutment with the cushion 35, whereby the pedal 7 is returned to the non-stepped-on state shown in FIG. 3.

As described above, according to the pedal device 1 of the present embodiment, since the pedal 7 is supported on the support portion 30 of the chassis 8 made of a synthetic resin via the cover 15 made of a synthetic resin, such as a polyacetal resin, differently from a case where the pedal body 14 made of a metal is directly supported, it is possible easily secure a smooth pivotal motion of the pedal 7 and a smooth pedal touch, without using lubricant for the support portion 30 and the like, and sufficiently suppress noise caused by the pivotal motion of the pedal 7.

Further, since the guide part 21 for limiting the lateral movement of the pedal 7 by the guidance of the guide hole 31 of the chassis 8 is also made of a synthetic resin, it is possible to suppress noise caused by contact with the walls of the guide hole 31, and easily maintain a smooth pedal touch, without using lubricant for the guide part 21 and the like.

Further, since the fins 23, 23 of the cover 15 and the horizontal part 21*b* of the guide part 21 prevent external light from entering the chassis 8 from below and above, it is possible to sufficiently limit the amount of external light received by the light-receiving element 9*b* of the optical sensor 9, whereby it is possible to secure a stable operation of the optical sensor 9 to accurately detect the stepped-on amount of the pedal 7.

Further, since the reflecting surface portion (the front part 15*d* of the top wall 15*a* of the cover 15) that reflects light emitted from the light-emitting element 9*a* of the optical sensor 9 is also formed of a synthetic resin, it is possible to avoid a malfunction caused by rust formed e.g. in a case where the pedal body 14 made of a metal is used as a reflecting surface portion, to thereby secure a stable operation of the optical sensor 9.

Further, the coil spring 11 for returning the pedal 7 to step-on operation can be easily positioned at the predetermined location simply by fitting the coil spring 11 on the positioning protrusion 24.

The guide part 21, the fins 23, the horizontal part 21*b*, the reflecting surface portion, and the positioning protrusion 24 having the respective functions described above are all integrally formed with the cover 15, which makes it possible to completely eliminate the need to use separate component parts having respective functions similar to those described above, whereby the manufacturing costs of the pedal device 10 can be largely reduced.

Further, since the chassis 8 is formed with the pedal-holding sections 28 and the openings 29 open downward, it is possible to insert the pedals 7 into the chassis 8 from below through these. Therefore, even when the pedal 7 has the cover 15, as in the present embodiment, and the cross-sectional shape of the cover 15 varies in longitudinal, it is possible to accommodate the pedal 7 in the chassis 8 by forming the pedal-holding sections 28 and the openings 29 into a shape matching that of the pedal 7. This enhances the degree of freedom of the shape of the pedal 7. In addition, since the pedal-holding sections 28 and the openings 29 of the chassis 8 open downward, a portion of a mold for use in molding the chassis 8 is not required to be formed such that it has a sliding structure as in the prior art, which makes it possible to further reduce the manufacturing costs.

Further, the pedal-holding sections 28 and the openings 29 of the chassis 8 are blocked with the presser plate 12 fixed to the chassis 8. Therefore, it is possible to cause the presser plate 12 to hold the pedals 7 and the coil springs 11 such that they are prevented from falling off downward, and use the presser plate 12 as a lower limit stopper for having the stepped-on pedal brought into contact therewith to set the lower limit position of the pedal 7. Further, since the presser plate 12 is formed of a metal, and has high rigidity and strength, it is possible to sufficiently support load applied from the depressed pedal 7 and sufficiently suppress deformation of the presser plate 12. Furthermore, the presser plate 12 is formed by a single plate to be shared by the three pedals 7, so that differently from a case where a plurality of presser plates are provided separately for the respective pedals 7, it is possible to reduce the number of component parts, and thereby further reduce the manufacturing costs.

Further, prior to fixing the presser plate 12 to the chassis 8 by the screws 48, the pressure plate 12 is provisionally fixed to the chassis 8 using the hooks 41 of the chassis 8 and the engaging holes 46 of the presser plate 12, in a state in which the coil springs 11 are compressed. Therefore, differently from the prior art, it is possible to easily fix the presser plate 12 to the chassis 8 by the screws 48, without causing compression of the coil springs 11, in a state free from being influenced by the large spring forces of the coil springs 11, which makes it possible to very easily assemble the pedal device 1. Further, since each screw 48 is screwed into the metal presser plate 12 by tapping from the chassis side, it is possible to fully secure final mounting strength of the presser plate 12. Furthermore, means for provisionally securing the presser plate 12 can easily be implemented by the hooks 41 and the engaging holes 46, and when they are both engaged, by causing the rear edge of the engaging hole 46 to be brought into contact with the hook 41, the presser plate 12 can be properly and easily positioned at the predetermined location in the front-rear direction with respect to the chassis 8.

Furthermore, since the adjuster bolt 13 is mounted by being screwed into the screw hole 44 of the protrusion 43 formed on the pressure plate by fluing, a separate screwing member, such as an insert nut, can be dispensed with, which makes it possible to further reduce the manufacturing costs. Moreover, the presser plate 12 is formed of a metal and has the reinforcement parts 12*b*, 12*b* extending vertically from the main part 12*a*, which makes it possible to enhance the rigidity and strength of the presser plate 12. As a consequence, it is possible to sufficiently support load applied by the pedal 7 when it is stepped on and a reaction force received from the adjuster bolt 13 and sufficiently suppress deformation of the presser plate 12. In addition, the cushions 34 are affixed to the upper surface of the presser plate 12 before the presser plate 12 is attached to the chassis 8, which facilitates affixing of the cushions 34.

It should be noted that the present invention is not limited to the embodiment described above, but it can be practices in various forms. For example, although in the embodiment, the guide part 21, the fins 23, the horizontal part 21*b*, the reflecting surface portion, and the positioning protrusion 24 are integrally formed with the cover 15, any of these may be omitted as required, or provided as an separate component part.

Further, although in the embodiment, the coil spring 11 is used as a return spring for each pedal 7, any other suitable kind of spring may be employed in place the coil spring 11. Furthermore, although in the embodiment, the hooks 41 are provided on the chassis side and the engaging holes 46 are on the presser plate side as means for provisionally fixing the presser plate 12, this arrangement may be reversed, or alternatively, other suitable arrangement than the combination of the hooks and the engaging holes may be employed.

Moreover, although in the present embodiment, the present invention is applied to an electronic piano by way of example, this is not limitative, but it is possible to apply the present invention to the pedal devices of other kinds of keyboard instruments, such as the external pedals of a keyboard or the like, and the expression pedals of an organ or the like. It is to be further understood that various changes and modifications may be made without departing from the spirit and scope thereof.

INDUSTRIAL APPLICABILITY

The pedal device for a keyboard instrument according to the present invention is used e.g. in an electronic piano, and secures a required pedal action. Further, the pedal device is easy to assemble, and is useful in reducing manufacturing costs.

The invention claimed is:

1. A pedal device for a keyboard instrument, including:

a chassis having a support portion, and a pedal vertically pivotally mounted on said chassis, for a downward stepped-on operation, wherein said pedal comprises:

a cover that is formed of a synthetic resin, and is pivotally supported on said support portion of said chassis; and a pedal body that is fixed to said cover in a state in which a rear part of said pedal body is covered by said cover, and protrudes forward from said chassis.

2. A pedal device as claimed in claim 1, wherein a guide portion is integrally formed with said cover, for being guided by said chassis to thereby restrict a lateral movement of said pedal.

3. A pedal device as claimed in claim 1 or 2, further comprising an optical sensor provided inside said chassis, for detecting a stepped-on amount of said pedal, wherein a light-shielding portion is integrally formed with said cover, for blocking light from entering said optical sensor from outside of said chassis.

4. A pedal device as claimed in claim 3, wherein said cover has a reflecting surface portion integrally formed therewith, and wherein said optical sensor is formed by a reflection-type optical sensor which has a light-emitting element, and a light-receiving element, and detects said stepped-on amount of said pedal by receiving light emitted from said light-emitting element and reflected from said reflecting surface portion, using said light-receiving element.

5. A pedal device as claimed in any of claims 1 to 4, further comprising a coil spring for returning said pedal after the stepped-on operation, wherein said cover is integrally formed with a positioning protrusion for positioning said coil spring.

6. A pedal device for a keyboard instrument, comprising:

a chassis;

a pedal vertically pivotally supported on said chassis, for a downward stepped-on operation;

an optical sensor provided inside said chassis, for detecting a stepped-on amount of said pedal; and a light-shielding member formed of a synthetic resin and integrally formed with said pedal, for blocking light from entering said optical sensor from outside of said chassis.

7. A pedal device as claimed in claim 6, wherein a guide portion is integrally formed with said light-shielding member, for being guided by said chassis to thereby restrict a lateral movement of said pedal.

8. A pedal device as claimed in claim 6 or 7, wherein said light-shielding member has a reflecting surface portion integrally formed therewith, and wherein said optical sensor is formed by a reflection-type optical sensor which has a light-emitting element, and a light-receiving element, and detects said stepped-on amount of said pedal by receiving light emitted from said light-emitting element and reflected from said reflecting surface portion, using said light-receiving element.

9. A pedal device as claimed in any of claims 6 to 8, further comprising a coil spring for returning said pedal after the stepped-on operation, wherein said light-shielding member is integrally formed with a positioning protrusion for positioning said coil spring.

10. A pedal device for a keyboard instrument, comprising:

a chassis;

a pedal vertically pivotally supported on said chassis, for a downward stepped-on operation;

an optical sensor provided inside said chassis, for detecting a stepped-on amount of said pedal; and a guide member formed of a synthetic resin and integrally formed with said pedal, for being guided by said chassis to thereby restrict a lateral movement of said pedal, wherein said guide member has a reflecting surface portion integrally formed therewith, and the pedal device further comprising a reflection-type optical sensor which has a light-emitting element, and a light-receiving element, and detects a stepped-on amount of said pedal by receiving light emitted from said light-emitting element and reflected from said reflecting surface portion, using said light-receiving element.

11. A pedal device as claimed in claim 10, further comprising a coil spring for returning said pedal after the stepped-on operation, wherein said guide member is integrally formed with a positioning protrusion for positioning said coil spring.

12. A pedal device for a keyboard instrument, comprising:

a chassis having an opening which opens downward;

a pedal vertically pivotally supported on said chassis and protruding forward from the opening, for a downward stepped-on operation;

a return spring disposed under said pedal, for retuning said pedal after the stepped-on operation; and a plate fixed to said chassis in a state in which said return spring is interposed therebetween, in a manner blocking the opening.

13. A pedal device as claimed in claim 12, wherein said chassis is formed of a synthetic resin, and said plate is formed of a metal.

14. A pedal device as claimed in claim 12 or 13, wherein said pedal is formed by a plurality of pedals arranged in a left-right direction, said return spring being formed by a plurality of return springs provided for said pedals, respectively, said plate being formed by a single plate fixed to said chassis in a state in which said return springs are interposed between said chassis and said plate.

15. A pedal device for a keyboard instrument, comprising:

a chassis having an opening which opens downward;

a pedal vertically pivotally supported on said chassis and protruding forward from the opening, for a downward stepped-on operation;

a return spring disposed under said pedal, for retuning said pedal after the stepped-on operation;

a plate disposed under said return spring;

provisional fixing means for provisionally fixing said plate, in a state in which said return spring is compressed, in a manner blocking the opening; and a screw for fixing said plate provisionally fixed by said provisional fixing means, to said chassis.

16. A pedal device as claimed in claim 15, wherein said provisional fixing means has:

an engaging hole formed in one of said chassis and said plate; and a hook provided on the other of said chassis and said plate, for being engaged with said engaging hole.

17. A pedal device as claimed in claim 15 or 16, wherein said chassis is formed of a synthetic resin, and said plate is formed of a metal, said screw being screwed into said plate from said chassis side.

18. A pedal device for a keyboard instrument, comprising:

a chassis having an opening which opens downward;

a pedal vertically pivotally supported on said chassis and protruding forward from the opening, for a downward stepped-on operation;

a return spring disposed under said pedal, for retuning said pedal after the stepped-on operation;

a plate formed of a metal and having a screw hole-provided protrusion formed by fluing, said plate being fixed to said chassis in a state causing compression of said return spring, in a manner blocking the opening; and an adjuster bolt screwed into the screw hole of said protrusion from below, for supporting load from said pedal.

19. A pedal device as claimed in claim 18, wherein said plate has a main part extending horizontally, and a reinforcement part extending perpendicularly from said main part.

20. A pedal device as claimed in claim 18 or 19, wherein a cushion is affixed to a top surface of said plate, for having said pedal brought into contact therewith when said pedal is stepped on.

* * * * *